US005087194A

United States Patent [19]

Viessmann

[11] Patent Number: 5,087,194

[45] Date of Patent: Feb. 11, 1992

[54] BLOWER-TYPE BURNER SUITABLE FOR USE WITH HEATING BOILERS EMPLOYING GAS RETURN DUCTING

[76] Inventor: Hans Viessmann, Im Hain, D-3559 Battenberg/Eder, Fed. Rep. of Germany

[21] Appl. No.: 571,757

[22] Filed: Aug. 22, 1990

[30] Foreign Application Priority Data

Aug. 28, 1989 [DE] Fed. Rep. of Germany ..... 3928384

[51] Int. Cl.[5] ..... F23C 9/00

[52] U.S. Cl. ..... 431/115; 431/159; 431/154; 431/187; 431/182

[58] Field of Search ..... 431/9, 115, 116, 181, 431/182, 183, 159, 187, 188, 154; 110/204, 205, 206, 207

[56] References Cited

U.S. PATENT DOCUMENTS 2,690,795 10/1954 Webb ..... 431/188 X
3,437,085 4/1969 Perry ..... 431/115 X
4,171,946 10/1979 Vollerin ..... 431/353 X

FOREIGN PATENT DOCUMENTS 969463 6/1975 Canada ..... 431/116
2365186 7/1975 Fed. Rep. of Germany ..... 431/9
8708656 9/1988 Fed. Rep. of Germany .
8812090 1/1989 Fed. Rep. of Germany .
3820671 12/1989 Fed. Rep. of Germany .
0155010 9/1982 Japan ..... 431/114

*Primary Examiner*—Carl D. Price
*Attorney, Agent, or Firm*—Collard, Roe & Galgano

[57] ABSTRACT

There is disclosed a blower-type burner for use with heating boilers which is effective for reducing $NO_x$ pollutants produced by flue gases. The device is mountable about an opening in a closure or sealing panel of a furnace body and provides for containment of the flue gas path within the burner. A separated dual impeller system provides for complete separation of the flue gas path from a combustion intake system.

10 Claims, 4 Drawing Sheets 17
18
2
6
1
10
11
27'
29
4
35
A
18
12
28
13
19
15'
28'
10'
26
10"
29'
25
23
5
9
15
17
14
7'
7
5'
22
16
8
3
21
24
6

BLOWER-TYPE BURNER SUITABLE FOR USE WITH HEATING BOILERS EMPLOYING GAS RETURN DUCTING

FIELD OF THE INVENTION

The present invention relates to a blower-type burner suitable for use with heating boilers employing flue gas return ducting.

BACKGROUND OF THE INVENTION

Prior art attempts at reducing the $NO_x$ component present in flue gases, a proven contributor to environmental pollution, have involved returning a portion of the flue gas back to the combustion chamber, which is then mixed with the combustion air. In such conventional systems, a well-insulated return duct, fitted to the outside of the boiler, is connected to the flue gas-collecting region of the boiler to the intake region of the impeller housing of the burner. In German Utility Patent No. U-87 08 656, the requirement for a long flue gas return duct is eliminated by the direct mounting of the burner, and in this case where there is a gravity-type burner, on the upper portion of the boiler casing. This system, however, uses a relatively short duct to return flue gas from a flue gas collection chamber, which is located inside the boiler, back to the impeller chamber of the burner, where such flue gases are mixed with the incoming combustion air.

Common to all of the prior art is the provision both of flue gas return ducts of varying lengths and of impeller units aiding the return of flue gas to the burner. Each of the extra impeller units is provided with its own power source. A third common factor is the direct return of flue gases through the burner's air intake or air mixture path, an arrangement that allows the burner, which is provided with an injection nozzle, to be charged with flue gases. Disclosed in German Utility Patent No. U-88 12 090 is a system designed to prevent the burner itself from being charged with gas. In this embodiment, the exhaust section of the flue gas return duct is aimed at the flame region of the burner. This design basically employs ducting and support apparatus located on the outside of the boiler casing and burner, rather than a direct connection between boiler and burner.

SUMMARY OF THE INVENTION

In accordance with the blower-type burner of the present invention, there is provided a blower-type burner suitable for use with a heating boiler having a flue gas return system and including a flue gas withdrawal region, the blower-type burner comprising: a housing having a first opening on a side facing the heating boiler, a closure panel for mounting to the heating boiler, the blower-type burner being mounted on the closure panel; the housing having a mixing tube, an injection nozzle and a first blower impeller, the mixing tube having an interior cavity; a drive motor having a shaft, the first blower impeller being mounted on the shaft and being oriented perpendicularly to the plane of the first opening of the housing, the housing having a wall adjacent the blower impeller, the wall having a opening for providing air to the blower impeller, the blower type burner further including an impeller chamber communicating with the inner cavity of the mixing tube, the housing having on one side of the closure panel a partitioning wall forming a flue gas chamber and an impeller chamber, the impeller chamber being oriented parallel to the flue gas chamber, the injection nozzle and the shaft extending through the partitioning wall, a second impeller associated with the shaft and extending into the flue gas chamber; and a flue gas outlet, the flue gas outlet being arranged in conjunction with the further impeller proximate a flue gas withdrawal region of the heating boiler closure panel, the flue gas chamber being connected to the inner cavity of the mixing tube.

The innovative arrangement of the blower burner allows the entire flue gas return system to be concentrated about a single opening in the sealing panel of the furnace body, while the entire flue gas return path is concentrated inside the burner itself. In accordance with the present invention, the apparatus provides for the complete separation of the flue gas return path from the combustion air intake system. The second impeller, which serves to draw flue gases from the boiler, utilizes the power supplied by the motor that drives the combustion air intake impeller, and therefore does not require a separate or special drive system.

In the apparatus of the present invention, apart from the second impeller, which is required in order to recycle flue gases, the only other additional component required by the burner structure is provision for separation of the burner housing into one section for the intake of combustion air, and another section for the flow of flue gases. Such separation can, for example, be accomplished by means of a partitioning or dividing wall. The extra expense involved in this is minimal however, since separation of the burner housing into two distinct portions can be accomplished when the housing is manufactured by, e.g., moulding techniques.

Advantageously, and preferably, the mixing tube has a double-walled construction. The cavity or chamber thus formed, which leads to one or more flue gas expulsion or outlet orifices, is also connected to the flue gas chamber. This arrangement prevents any part of the injection nozzle from coming into contact with the flue gases.

The construction of the air intake and flue gas flow chambers, which are oriented perpendicularly to both impellers, are conventional and thus need not be described in greater detail, comprise, when viewed along the extension of the injection nozzle, two contiguous cavities having spiral ribbing, which is a conventional feature of burners of this type.

A principle object of the present invention is to provide a blower type burner in which there is complete separation of the combustion air and flue gas supplies and removal plates.

A further object of the present invention is to provide a blower-type burner which supercedes conventional type burners without an increase in the operating costs thereof.

A still further object of the present invention is to provide a blower-type burner which can be manufactured using an environmentally friendly moulding procedure i.e. a procedure which does not employ the use of a core.

Yet another object of the present invention is to provide a blower-type burner in which the exiting gas stream can be adjusted to thereby enhance $NO_x$ reduction.

A further object of the present invention is to provide a blower-type burner in which the combustion air and flue gas impeller are separate and independant.

In alternate embodiments the sealing plate between the impellers may include means to increase sealing effectiveness, e.g., peripherally associated magnets or, the impellers may be separated by a solid permanent wall.

In addition, the mixing tube can contain adjustable internal deflectors or the baffles which will cause the flue gas and burner flame to spiral in opposite directions. Further, the interior cavity may contain such apparatus or modification thereof to facilitate more precise adjustment of the expulsion stream for greater $NO_x$ reduction.

The blower burner of the present invention, together with its advantageous alternate embodiments set forth herein, will be described hereinafter in greater detail; having thus generally described the invention, reference will now be made to the accompanying drawings, illustrating preferred embodiments.

DETAILED DESCRIPTION OF THE PREFERRED EMBODIMENTS

Figure 2:
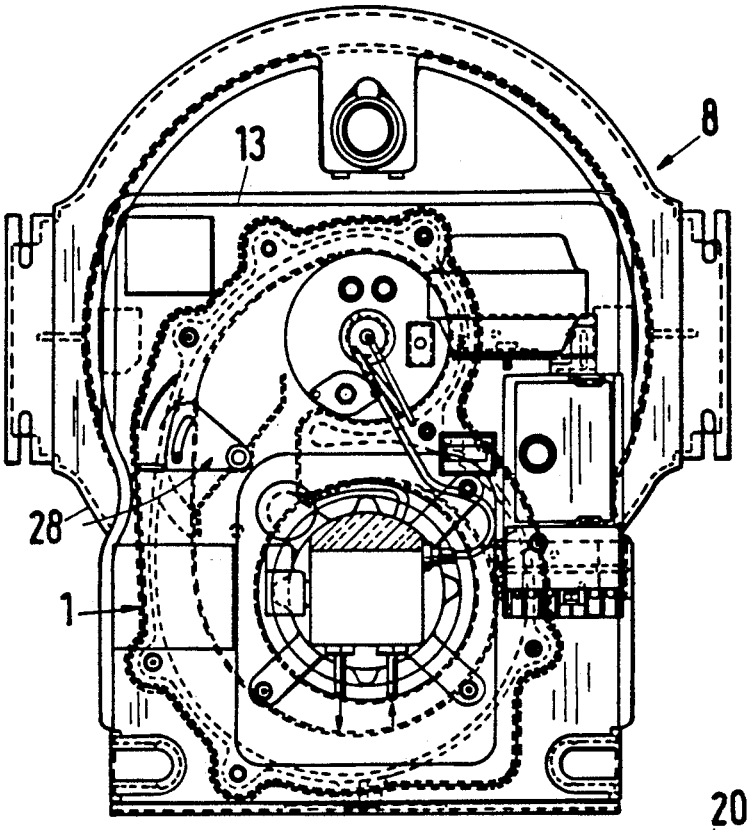
FIG. 2 is a front view of FIG. 1 of the blower burner, seen in the direction of arrow A.

Referring now to the drawings in greater detail, wherein like reference numerals designate like parts in all figures, the blower burner comprises a housing 1 which is open on one side facing the boiler, and which can be mounted upon a heating boiler sealing or closure panel 8. Arranged in housing 1 is a mixing tube 10, an injection nozzle 4 and a blower impeller 7 which serves to draw in combustion air from the outside. Impeller 7 is attached to a shaft 5 of a motor 5' which is oriented perpendicularly to the plane of the housing opening. In this embodiment, a combustion air intake 28 is provided for the blower impeller 7 o the side of the motor in an adjoining housing wall. In addition, an impeller chamber 3, which forms part of the combustion air intake system, communicates with the inner cavity or chamber of the mixing tube 10. The sealing or closure panel 8 of the heating boiler which, in the present example, is the furnace body door, (see FIG. 2) forms part not only of the heating boiler (not shown), but also of the housing 1 of the burner; it is to be noted that the absence of such sealing panel would render both the burner and the heating boiler incapable of operating.

To overcome the problems of the prior art blower burner, the present invention provides for the installation of a flue gas chamber 2 near the closure or sealing panel 8 and an impeller chamber 3 extending parallel to the flue gas chamber 2 which serves to feed combustion air to the burner. Also provided is a dividing or partitioning wall 6 that is penetrated by both the injection nozzle 4 and the shaft 5 with the extension of the latter, in the flue gas chamber 2, bearing a further impeller 7' for drawing flue gas out of the boiler. Arranged in the vicinity of the impeller 7' and in sealing panel 8 is a flue gas outlet 9. According to a preferred embodiment, the mixing tube 10 is of a double-walled construction and an annular inner cavity 11 therebetween is connected at one end thereof to the flue gas chamber 2 while terminating at the other end in an opening 12 which is oriented in the direction of the injection nozzle outlet.

Figure 1:
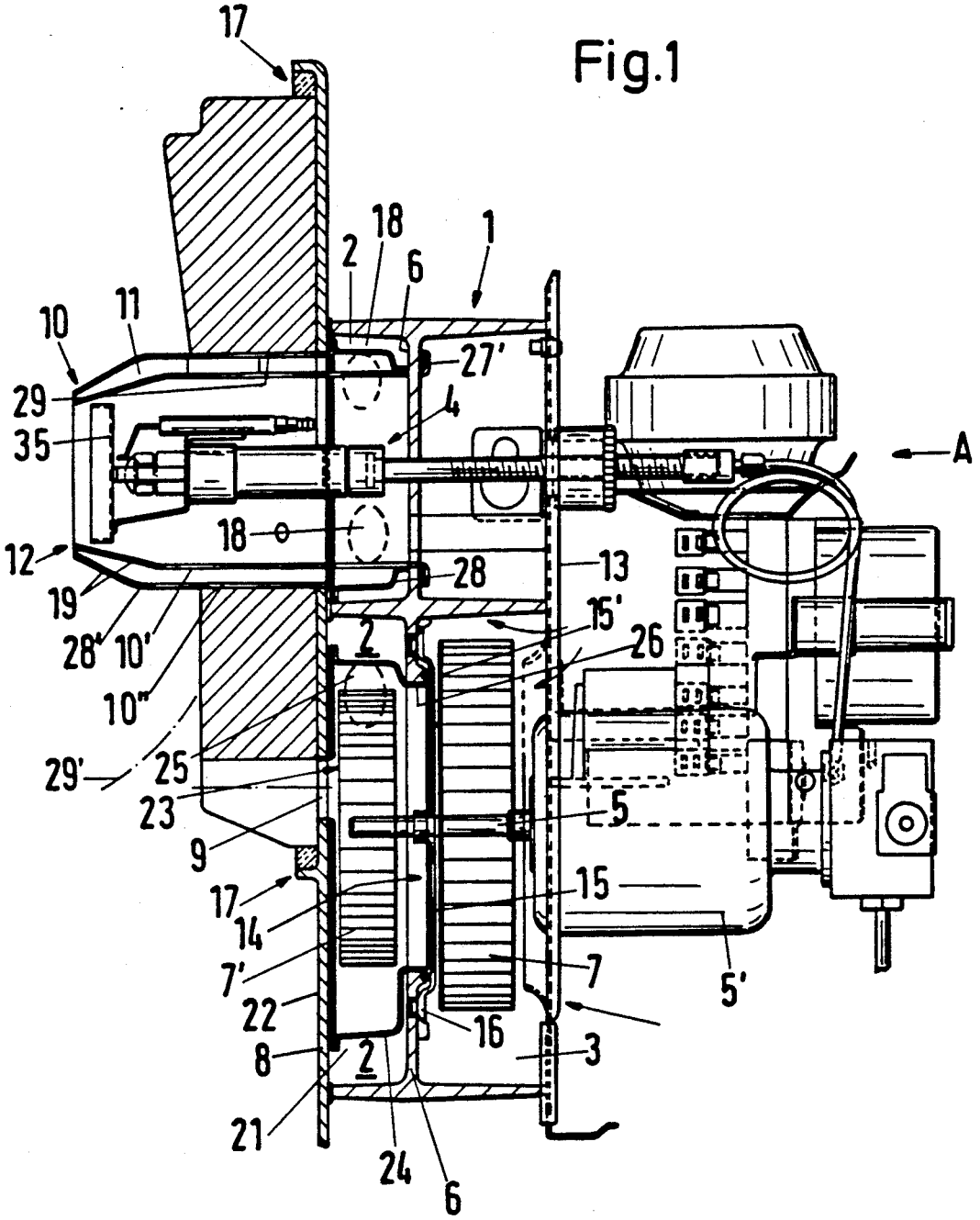
FIG. 1 is a longitudinal section through a burner, as seen mounted on the furnace door of a heating boiler.

It will be appreciated from FIG. 1, that apart from flue gas outlet 9, which is located in sealing or closure panel 8, the entire flue gas return system is concentrated inside the burner, i.e., inside the housing 1. In this manner and by this arrangement, the flue gases, having been drawn off by second impeller 7', reach the mixing tube 10 by the shortest path possible without coming into contact, and mixing, with the combustion air drawn in through the combustion air intake 28. Once having arrived at mixing tube 10, the flue gas, rather than entering the interior cavity containing injection nozzle 4, enters the annular cavity 11 in the double wall of the mixing tube. After being recycled from the flue gas chamber (2) to inner cavity 11, the flue gas is pressurized and expelled as a "tubular" stream through the flue gas exhaust opening 12 located at the end of the cavity 11. The latter can, instead of having an annular shape, be formed by a plurality of separate openings, which can be oriented either obliquely or parallel to the longitudinal axis of the mixing tube depending on application, to allow for maximum $NO_x$ reduction.

In order to facilitate both the installation and the removal of impellers 7, 7', and in order to be able to construct the same together with a motor 5' in one installable or removable unit, the impeller chamber 3 of housing 1 may be closed off by a panel 13 that mounts the elements of the burner and the motor for the blower. A plate 15, which serves to seal off a mounting opening 14, is located in the dividing or partitioning wall 6 and is sized to fit around shaft 5, connecting impeller 7 to impeller 7'. The diameter of mounting opening 14 is large enough to allow impeller 7' to pass therethrough. The sealing effectiveness of plate 15 can be increased if, as shown in FIG. 1, one or more magnetic adhesive elements 16 are arranged along the edge of either mounting opening 14 or plate 15. Adhesive elements 16 can be annular in shape or can comprise a plurality of individual magnets joined together to form a ring. Advantageously, and as shown in FIG. 1, an annular seal 15', which provides a gas-tight separation between chambers 2 and 3, is provided in the region of contact between plate 15 and the dividing or partitioning wall 6. The construction shown in FIG. 4 also permits installation of the impeller 7' and the sealing off of chamber 2 from chamber 3 without the interposition of plate 15. In this embodiment, impeller 7', which serves to draw flue gas into the return stream, is both provided with its own housing and is coupled to the blower impeller 7 by means of a suitable reasonably flexible coupling arrangement.

Figure 4:
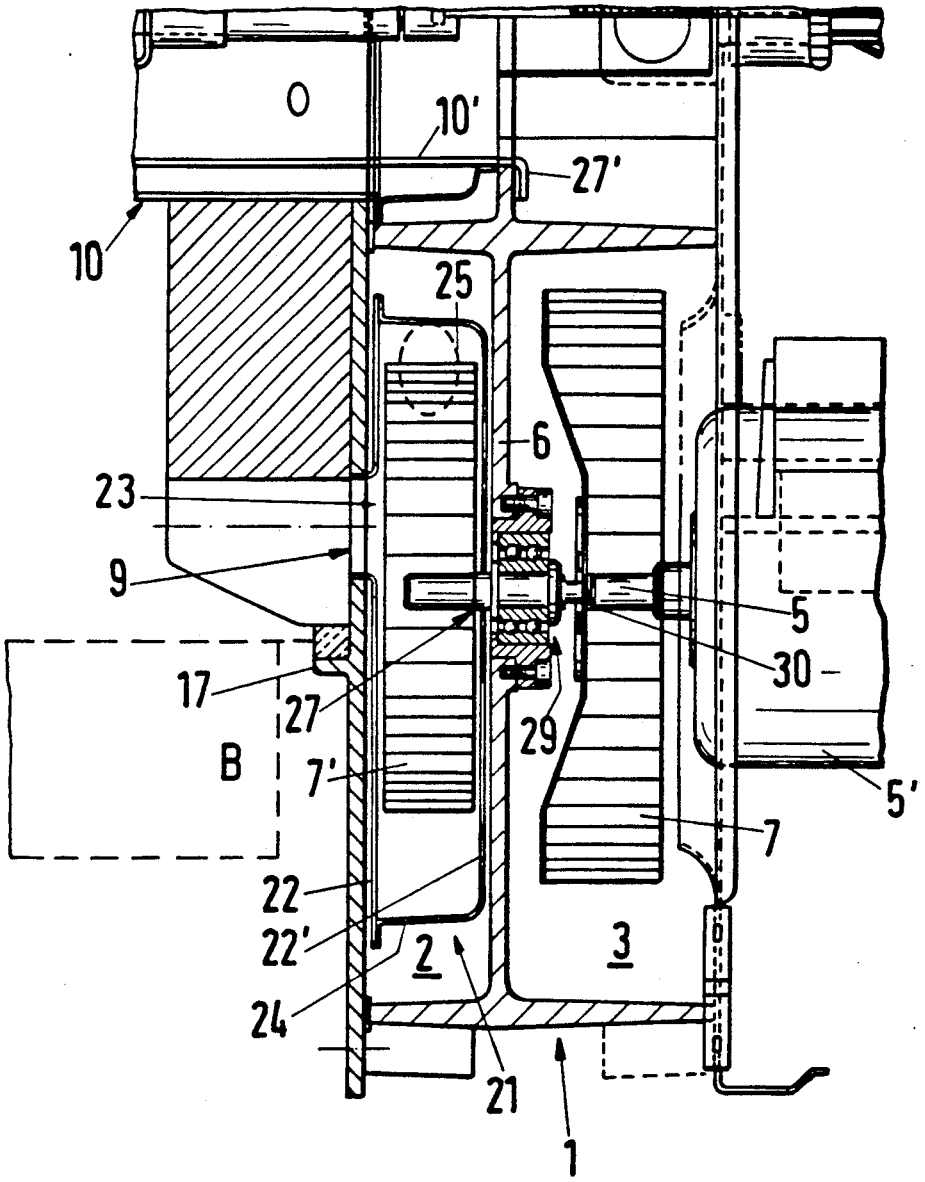

Referring back to FIG. 1, in order to be able to draw off the desired quantity of flue gas from the zone of the heating boiler to which the burner is attached, and in which the flue gases have also been cooled off to a considerable extent, flue gas outlet 9 is located directly adjacent joint ledge 17 of sealing panel 8 and near the centre of impeller 7'. This design provides for the alignment of a flue gas outlet 23 with the relatively cool bottom region B, as shown in FIG. 4, of the furnace, or, more specifically the combustion chamber, provided that the longitudinal axis of the furnace body is horizontal. In an arrangement involving a location of the burner on the top of a gravity-type burner, the flue gas collection chamber will be located near the top of the boiler, but below the burner. In the case of a horizontally-oriented boiler, where due to the construction of the combustion chamber (e.g. a floorless combustion chamber), and where the flue gases collecting in the vicinity of sealing panel 8 reach the flue gas outlet, the burner can be arranged so that outlet 23 lies in the immediate vicinity of the flue gas outlet.

As shown in FIG. 1 by means of a broken line, a baffle plate 29 can be provided in front of the outlet 23 in order to prevent flue gas from flowing directly into outlet 23 and to permit the withdrawal of a quantity of flue gas which, by virtue of its contact with the normally-ribbed adjacent furnace body wall, has cooled down considerably.

Mixing tube 10 has an inner sleeve 10' and an outer sleeve 10''. Extension 18 of mixing tube 10 extends into flue gas chamber 2, and may have one or more flue gas intakes 18'.

Figure 5:
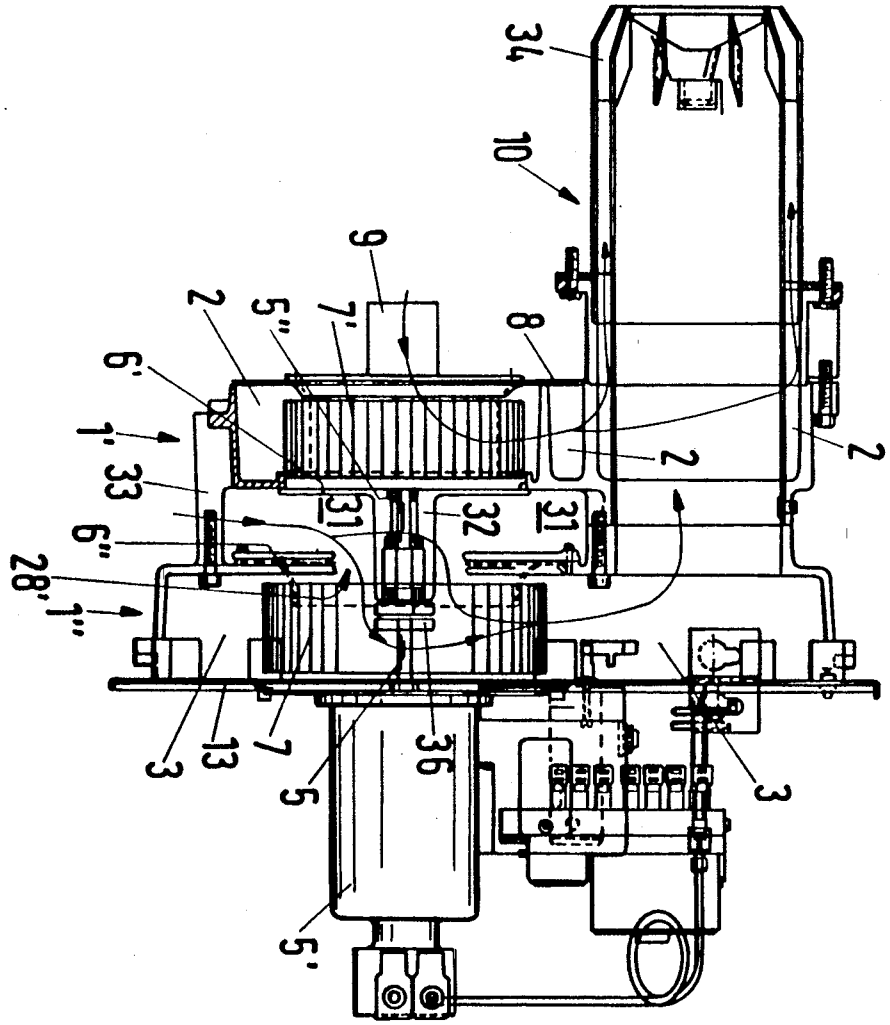
FIG. 5 is a longitudinal section showing an embodiment of a burner for a high-output heating boiler.

In this arrangement, the double walls of the mixing tube 10 assume the form of a truncated cone slightly upstream of the opening 12, which is oriented in the direction of the flue gas expulsion. Both sides of mixing tube 10, by converging in the direction of the exhaust gas stream, serve to direct the gases at the burner flame located immediately downstream of a retarding plate 35. The converging end sections 19 of sleeves 10', 10'', which are located near the mouth of the mixing tube, can be adjusted in relation to each other. Such an adjustment merely requires the addition of suitably designed annular extensions either to the inner sleeve 10' and/or to the outer sleeve 10''. Such modification of the length of the sleeves can change the direction of the exiting "tubular" gas stream and thus enable more precise adjustment for the purpose of $NO_x$ reduction. It is, moreover, useful and advantageous to position, either inside the inner cavity 11 and/or inside the mixing tube itself, and slightly upstream of the exhaust orifices, baffle plates 34, as shown in FIG. 5, which can cause the burner flame and the expelled flue gas to twist or spiral in opposite directions.

The flue gas chamber 2, which is located inside the housing 1, can be designed in a number of ways. For example, the embodiment shown in FIG. 3 includes the feature that an inner wall of the flue gas chamber 2 is lined with a suitable insulating layer 20, not only in the region of impeller 7', but which also embraces the region of flue gas chamber 2 into which the mixing tube 10 extends. As FIGS. 1 and 4 indicate, it is also possible to house impeller 7' inside a capsule 21 (e.g. fabricated from thin specialty steel), which is provided in its wall 22, located near the sealing panel, with outlet 23, and in its circumferential wall 24 with a gas outlet 25.

In the embodiment illustrated in FIG. 1, capsule 21 passes through mounting opening 14 located in the dividing wall 6, which features an out-turned lip 26. In this embodiment, plate 15 can also be manufactured from a specialty steel. In the embodiment shown in FIG. 4, capsule 21 completely envelopes impeller 7', i.e. capsule 21 is, in this arrangement, provided with a mounting opening 27, which surrounds shaft 5 that extends through a motor-side wall 22'. In addition to any seal that may be provided around mounting opening 27, the bearing illustrated is suitably sealed (not shown) against possible passage of flue gases.

Figure 3:
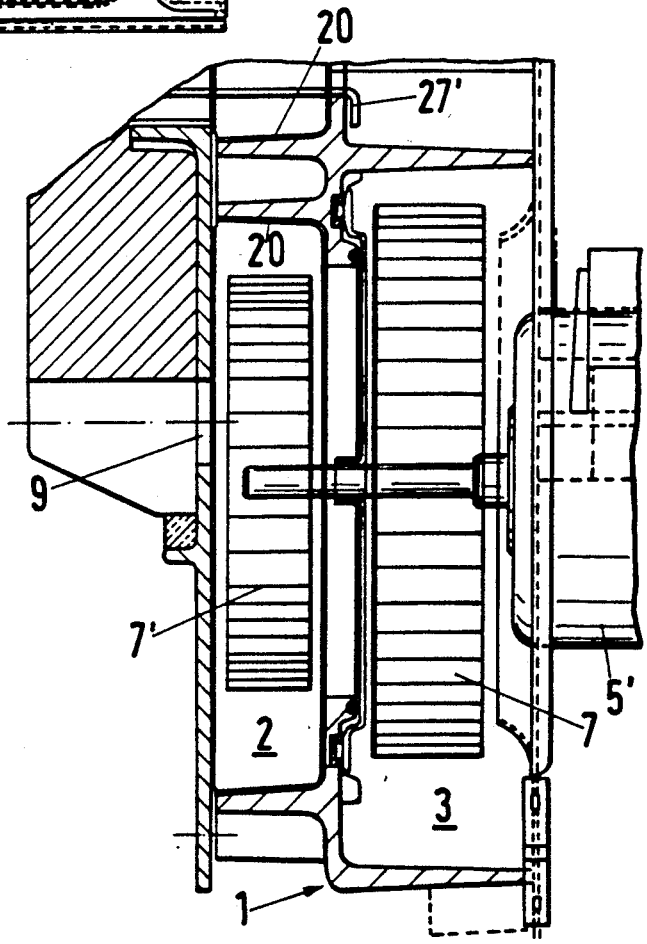
FIGS. 3 and 4 are a longitudinal sections, showing alternative embodiments of the regions surrounding both impellers.

Inner sleeve 10' of mixing tube 10 has a lip 27', in order to facilitate construction and mounting, on the intake side (See FIG. 3). Outer sleeve 10'' of mixing tube 10 extends, as FIG. 1 indicates, inside flue gas chamber 2, a sleeve segment 28 is provided with one or more gas intakes 18', and in its forward portion has an upwardly inclined segment 30. Such an arrangement permits capsule 21 and segment 30 to be designed as a single unit which can be manufactured by stamping or deep drawing either from a blank sheet of metal or from thin specialty steel. Since housing 1 is open on the side of sealing panel 8, it is a relatively simple matter to insert such a part into the housing itself.

It will be appreciated from the illustration of impeller housing 1 that all of the walls oriented in the direction of injection nozzle 4 and impeller shaft 5 slope slightly, a condition that can be formed by "environmentally friendly" techniques—e.g., coreless moulding processes. The blower burner is designed in particular for use with heating boilers of low output capacity. The relatively small impellers can either be accommodated on a common shaft 5, or coupled, as FIG. 4 indicates, to a relatively small bearing 30 mounted on the dividing wall 6.

The embodiment shown in FIG. 5 is designed with specific reference to blower burners that are employed in conjunction with higher-output heating boilers. FIG. 5 is different from the previously described embodiments in that, arranged between impeller chamber 3 and flue gas chamber 2 of housing 1, there is provided a combustion air intake chamber 31, so that the dividing wall portion 6', which seals off flue gas chamber 2, is embodied as a housing 32. The latter component, being positioned centrally in relation to impeller 7', extends through air intake chamber 31, while the other dividing or partitioning wall portion 6'', which forms the outside of impeller chamber 3, is in the form of an air intake 28'.

In a preferred embodiment of the invention, and in order to efficiently manufacture the apparatus of the present invention, which is to say, to be able to mould the burner components according to environmentally-friendly methods, and furthermore, in order to be able to assemble and disassemble the apparatus as easily as possible, housing 1 (as FIG. 5 shows) may have two sections 1' and 1'' which may be joined together. Combustion air intake chamber 31, which is located between parts 1', 1'' may, in this arrangement, be left entirely open to the outside, while in the lower region, connecting bolts 33 may be used to join together sections 1' and 1'' in a solid but non-permanent connection.

Shaft 5'' of impeller 7' is, in this arrangement, located inside elongated housing 32 and is connected via coupling 36 to the short power take-off shaft 5 of motor 5'. The arrangement of the housing 32 inside combustion air intake chamber 31 provides a system having the advantage that the housing 32 is constantly surrounded with fresh combustion air drawn in by the impeller 7 and is thus thoroughly cooled.

As those skilled in the art will realize, these preferred illustrated details can be modified without affecting the function of the illustrated embodiments. Thus, the invention is not limited thereto and it will be apparent to those skilled in the art that numerous modifications form part of the present invention insofar as they do not depart from the spirit, nature and scope of the claimed and described invention.

I claim:

1. A blower-type burner for heating a boiler having an interior and a wall opening closed by a closure panel having a joint ledge for mounting the closure panel on the boiler wall, the burner comprising (a) a housing mounted on the closure panel and open to the interior of the heating boiler in a plane extending substantially parallel to the closure panel, the housing being divided by a partition wall into
(1) a flue gas chamber adjacent the closure panel and
(2) an impeller chamber extending parallel to the flue gas chamber,
(b) a mixing tube including an injection nozzle arranged in the interior thereof, the mixing tube having
(1) a double wall defining an interior cavity in communication with the flue gas chamber and at least one flue gas exhaust opening for exhausting flue gas from the interior cavity, and
(2) the impeller chamber being in communication with the interior of the mixing tube,
(c) an impeller arrangement comprising
(1) a motor,
(2) a motor shaft extending perpendicularly to said plane into the impeller chamber,
(3) a blower impeller mounted on the motor shaft in the impeller chamber, and
(4) a further impeller in the flue gas chamber, the further impeller being coupled to the motor shaft for operation thereby,
(5) the injection nozzle and the motor shaft passing through the partition wall,
(d) an adjoining wall of the housing defining a combustion air intake for delivering a stream of combustion air to the blower impeller, and
(e) the closure panel defining a flue gas exhaust opening at a suction side of the further impeller, the flue gas exhaust opening being positioned immediately adjacent the joint ledge and the center of the further impeller.

2. The burner of claim 1, wherein the double wall of the mixing tube is comprised of an inner sleeve and an outer sleeve, the outer sleeve having a segment extending into the flue gas chamber and the outer sleeve segment defining at least one flue gas intake.

3. The burner of claim 2, wherein the inner sleeve has a lip securing the inner sleeve to the partition wall at the side of the impeller chamber.

4. The burner of claim 3, wherein the outer sleeve comprises a first sleeve section in the flue gas chamber, the first sleeve section having at least one flue gas intake, and a second sleeve section forwardly of the first sleeve section.

5. The burner of claim 1, wherein the double wall of the mixing tube has a truncated cone form upstream of the flue gas exhaust opening, the imaginary extension lines of the truncated cone converging.

6. A blower-type burner for heating a boiler having a high output capacity, the boiler having an interior and a wall opening closed by a closure panel, the burner comprising
(a) a housing mounted on the closure panel and open to the interior of the heating boiler in a plane extending substantially parallel to the closure panel, the housing being divided by a partition wall into
(1) a flue gas chamber adjacent the closure panel and
(2) an impeller chamber extending parallel to the flue gas chamber,
(3) a portion of the partition wall sealing off the flue gas chamber and comprising a casing extending through a combustion air intake chamber located between the flue gas and impeller chambers, and another partition wall portion bordering the impeller chamber including an air intake,
(b) a mixing tube including an injection nozzle arranged in the interior thereof, the flue gas and impeller chambers being in communication with the interior of the mixing tube,
(c) an impeller arrangement comprising
(1) a motor,
(2) a motor shaft extending perpendicularly to said plane into the impeller chamber,
(3) a blower impeller mounted on the motor shaft in the impeller chamber, and
(4) a further impeller in the flue gas chamber, the further impeller being coupled to the motor shaft in said casing for operation thereby, the casing being positioned centrally in relation to the further impeller,
(5) the injection nozzle and the motor shaft passing through the partition wall,
(d) an adjoining wall of the housing defining a combustion air intake for delivering a stream of combustion air to the blower impeller, and
(e) the closure panel defining a flue gas exhaust opening at a suction side of the further impeller.

7. The burner of claim 6, wherein the housing comprises a pair of detachable housing portions having a dividing plane extending generally perpendicularly relative to the longitudinal axis of the mixing tube and through the combustion air intake chamber.

8. A blower-type burner for heating a boiler having an interior and a wall opening closed by a closure panel, the burner comprising
(a) a housing mounted on the closure panel and open to the interior of the heating boiler in a plane extending substantially parallel to the closure panel, the housing being divided by a partition wall into
(1) a flue gas chamber adjacent the closure panel and
(2) an impeller chamber extending parallel to the flue gas chamber,
(b) a mixing tube including an injection nozzle arranged in the interior thereof, the flue gas and impeller chambers being in communication with the interior of the mixing tube,
(c) an impeller arrangement comprising
(1) a motor,
(2) a motor shaft extending perpendicularly to said plane into the impeller chamber,
(3) a blower impeller mounted on the motor shaft in the impeller chamber, and
(4) a further impeller in the flue gas chamber, the further impeller being coupled to the motor shaft for operation thereby,
(5) the injection nozzle and the motor shaft passing through the partition wall,
(6) the partition wall defining a mounting opening sized to permit the further impeller to be passed therethrough, and further comprising
(7) a plate mounted on the partition wall over the mounting opening and between the impellers, the motor shaft passing through the plate and the plate sealing off the mounting opening,
(d) an adjoining wall of the housing defining a combustion air intake for delivering a stream of combustion air to the blower impeller, and
(e) the closure panel defining a flue gas exhaust opening at a suction side of the further impeller.

9. The burner of claim 8, further comprising at least one magnetic element at the edge of the mounting opening and between the partition wall and the plate for holding the plate on the partition wall.

10. A blower-type burner for heating a boiler having an interior and a wall opening closed by a closure panel, the burner comprising (a) a housing mounted on the closure panel and open to the interior of the heating boiler in a plane extending substantially parallel to the closure panel, the housing being divided by a partition wall into
  (1) a flue gas chamber adjacent the closure panel and
  (2) an impeller chamber extending parallel to the flue gas chamber, (b) a mixing tube including an injection nozzle arranged in the interior thereof, the flue gas and impeller chambers being in communication with the interior of the mixing tube, (c) an impeller arrangement comprising
  (1) a motor,
  (2) a motor shaft extending perpendicularly to said plane into the impeller chamber,
  (3) a blower impeller mounted on the motor shaft in the impeller chamber,
  (4) a further impeller in the flue gas chamber, the further impeller being coupled to the motor shaft for operation thereby, and
  (5) a capsule enclosing the further impeller, the capsule having an end wall facing the closure panel and a circumferential wall defining a flue gas outlet,
  (6) the injection nozzle and the motor shaft passing through the partition wall, (d) an adjoining wall of the housing defining a combustion air intake for delivering a stream of combustion air to the blower impeller, and (e) the closure defining a flue gas exhaust opening at a suction side of the further impeller, and the end wall of the capsule having a flue gas outlet communicating with the flue gas exhaust opening in the closure panel.

* * * * *